US007267080B2

(12) United States Patent
Gallo et al.

(10) Patent No.: US 7,267,080 B2
(45) Date of Patent: Sep. 11, 2007

(54) CHILD SUPPORT HARNESS

(75) Inventors: Renata Gallo, Pompton Plains, NJ (US); Robert Gallo, Pompton Plains, NJ (US)

(73) Assignee: Branz, Inc., Pompton Plains, NJ (US)

( * ) Notice: Subject to any disclaimer, the term of this patent is extended or adjusted under 35 U.S.C. 154(b) by 87 days.

(21) Appl. No.: 11/202,818

(22) Filed: Aug. 12, 2005

(65) Prior Publication Data

US 2007/0034163 A1 Feb. 15, 2007

(51) Int. Cl.
*A62B 35/00* (2006.01)

(52) U.S. Cl. ..... 119/770

(58) Field of Classification Search ..... None
See application file for complete search history.

(56) References Cited

U.S. PATENT DOCUMENTS

| | | | | |
|---|---|---|---|---|
| 149,692 | A | 4/1874 | Tardy | |
| 321,867 | A | 7/1885 | Van Vleck | |
| 339,650 | A | 4/1886 | Hill | |
| 554,179 | A | 2/1896 | Gerl | |
| 1,193,374 | A | 8/1916 | Gilliam | |
| 1,310,958 | A * | 7/1919 | O'Connor | 297/484 |
| 1,749,999 | A | 3/1930 | Crocker | |
| 2,308,626 | A | 1/1943 | Reinholz | |
| 3,237,939 | A | 3/1966 | Olivet et al. | |
| 4,441,707 | A * | 4/1984 | Bosch | 482/131 |
| 5,074,795 | A * | 12/1991 | Clark | 434/253 |
| 5,120,287 | A | 6/1992 | Brown et al. | |
| 5,356,355 | A | 10/1994 | Campbell | |
| 5,411,461 | A * | 5/1995 | Thomascik | 482/124 |
| 5,498,219 | A * | 3/1996 | Soufi | 482/69 |
| 5,667,461 | A | 9/1997 | Hall | |
| 5,927,235 | A * | 7/1999 | Olaiz | 119/770 |
| 6,125,792 | A | 10/2000 | Gee | |
| 6,196,949 | B1 | 3/2001 | Rodarte | |
| 6,338,699 | B1 | 1/2002 | Veitch | |
| 6,361,478 | B1 | 3/2002 | Giancaspro | |
| 6,436,011 | B1 | 8/2002 | Cook | |
| 6,578,594 | B1 | 6/2003 | Bowen et al. | |
| 6,827,672 | B2 | 12/2004 | Miceli | |
| 2003/0207736 | A1 | 11/2003 | Munguia, Jr. | |
| 2003/0207737 | A1 | 11/2003 | Sherman et al. | |
| 2003/0236154 | A1 | 12/2003 | Miceli | |
| 2004/0192517 | A1 | 9/2004 | Shin | |

* cited by examiner

*Primary Examiner*—Thomas Price
(74) *Attorney, Agent, or Firm*—Lerner, David, Littenberg, Krumholz & Mentlik, LLP

(57) ABSTRACT

A child support harness for assisting children with walking, the harness having a belt adapted to circumscribe the child's midsection, the belt having a front position generally at the child's chest, a back portion generally at the child's back, a left side portion generally adjacent to the child's left hip, and a right side portion generally adjacent to the child's right hip. The harness also comprises a left support arm extending from the left side portion of the belt and a right support arm extending from the right side portion of the belt. The left and right support arms may be held by a supervisor to assist the child with walking. The support arms may also be utilized to steer the child in a supervisor-dictated direction. The support arms may extend from the belt at an angle other than zero degrees from a plane through the belt.

15 Claims, 5 Drawing Sheets

CHILD SUPPORT HARNESS

BACKGROUND OF THE INVENTION

The present invention relates to devices used in training toddlers to walk. More specifically, the present invention relates to a safety harness within which a toddler may be placed such that an adult supervisor may support the toddler's weight with handles extending from a belt portion of the harness while the toddler walks. The toddler may therefore walk without being required to support its entire weight. The adult supervisor may also steer the toddler in a supervisor preferred direction by manipulating the handles.

It is well known that infants learn to walk through a path of development comprising several stages. Initially, the infant may learn to stand while holding on to a supportive object. When the infant's coordination and strength increase, the infant may begin to walk along the supportive object while still holding on for support and balance. This is often referred to as "cruising." During this cruising stage, adult supervisors often grasp the toddler's hands and assist with walking while pulling the toddler's arms above its head, in an effort to move the child away from the security of the supportive object.

This technique may inadvertently place stress on the toddler's limbs, particularly the wrists and shoulders, leading to potential injury. The injury potential is particularly true in the common instance of the child falling forward and being pulled upward into an upright position by the child's hands and arms.

Walk assisting devices are known in the art to help alleviate this problem. Many of these devices comprise harnesses in which the infant child may be placed and where the harness may be supported by an adult supervisor. The prior art harnesses are typically elaborate devices which include numerous straps and buckles, and work to varying levels of effectiveness. Although some prior art devices are effective in supporting a child, it has been found that none are effective in steering a child in a preferred direction.

The prior harnesses known typically comprise either a single support which the adult supervisor may grasp with one or both hands, or two supports that require both hands to operate. In the case of the single support devices, the single support is often flexible. It is therefore self-evident that the adult supervisor may not steer the child in a preferred direction as the flexible support is incapable of imparting a steering force into the harness. Even if the single support is rigid, it is difficult to provide the required steering force with one hand. In the prior art devices that utilize two supports, the supports either extend from a rear section of the harness or a front section of the harness, and not from areas adjacent the hips, such that pulling either support to a greater degree than the other will not influence the child to turn in a particular direction, but will pull the child straight back toward the adult operator.

The present invention has arisen to solve this problem by providing for a child support harness which permits the adult supervisor to steer the child in a particular direction in addition to at least partially supporting the child while learning to walk.

SUMMARY OF THE INVENTION

The present invention overcomes the shortcomings of the prior art by providing, in certain embodiments, a child support harness, where the child support harness includes elements adapted to permit an adult supervisor to steer the toddler so as to direct the toddler's walking in a particular direction.

In accordance with one aspect of the present invention, there is provided a child support harness comprising a belt adapted to circumscribe a child's midsection, when circumscribing the child's midsection the belt may have a front portion generally at the child's chest, a back portion generally at the child's back, a left side portion generally adjacent to the child's left hip, and a right side portion generally adjacent to the child's right hip. A left support arm may extend from the left side portion of the belt and a right support arm may extend from the right side portion of the belt. Wherein the left and right support arms may be held by a supervisor to support the child while walking.

The fist support arm and the second support arm may be adapted for use in steering the child in a supervisor dictated direction.

The left support arm and the right support arm may extend toward the supervisor when situated behind the child.

The support arms may extend at an angle of between 30 and 60 degrees with respect to a plane formed by the belt.

The child support harness may further comprise a left shoulder strap and a right shoulder strap, each of the shoulder straps having a front portion associated with the front portion of the belt and a back portion associated with the back portion of the belt.

The shoulder straps may be adjustable to fit children of varying sizes.

The shoulder straps may comprise buckles to facilitate adjustment.

The belt may be adjustable to fit children of varying sizes.

The belt may further comprise a first end and a second end, the first end may have female hook-and-loop type fastening on one side of the belt and the second end may have corresponding male hook-and-loop type fastening on a second side of the belt such that the female and the male hook-and-loop type fastening may be connected when the belt is circumscribed about the child, the hook-and-loop type fastening adapted to provide an adjustment mechanism for adjusting the length of the belt to fit children of varying sizes.

The left support arm may comprise a first end at the belt and a distal second end, the distal second end may in turn comprising a length adjustment feature adapted to adjust the length of the left support arm.

The length adjustment feature may comprise a series of apertures wherein an extreme portion of the distal second end may be folded back upon remaining portions of the left support arm such that at least two apertures overlap to shorten the length of the left support arm.

The child support harness may further comprise hook-and-loop type fasteners between at least some of the apertures of the length adjustment feature, the hook-and-loop type fasteners adapted to facilitate connection of the folded portion of the distal second end with the remaining portions of the left support arm.

In accordance with further aspects of the present invention, a device for assisting toddlers with walking may comprise a belt having a first end and a second end, the belt having an open condition in which the first end is spaced from the second end to form a working area and a closed condition in which the first end is in communication with the second end to enclose the working area. The device may further comprise a first extension arm attached to the belt at a first side of the working area, and a second extension arm attached to the belt at a second side of the working area, the second side of the working area opposite the first side of the working area. Wherein a toddler may be placed in the working area of the belt in the closed position such that the toddler's hips may be adjacent the first and second sides of the working area so a supervisor may grasp and pull the first and second extension arms to at least partially support the toddler and assist the toddler with walking.

The first and second extension arms may extend from the belt at an angle other than zero degrees with respect to a plane formed through the belt in the closed condition.

The extension arms may comprise length adjustment mechanisms. The length adjustment mechanisms may in turn include apertures formed in the extension arms such that the extension arms may be folded to overlap at least two apertures, the apertures adapted to be grasped by the supervisor.

One support arm may be pulled to a greater extent than the other, the pulled support arm influencing a directional change in the walking toddler toward the direction of the pulled support arm.

The device may further comprise shoulder straps extending from a front portion of the belt to a rear portion, the shoulder straps adapted to be placed over the toddler's shoulders.

In yet another aspect of the present invention, a method of utilizing a child support harness to assist a toddler with walking, where the child support harness comprises a belt and a pair of extension arms extending from the belt, may comprise steps. The steps may include placing a belt portion of a child support harness around the mid-section of a child, grasping the first of a pair of extension arms extending from the child support harness, grasping the second of the pair of extension arms extending from the child support harness, and at least partially supporting the child's weight with the extension arms. The steps may also include pulling on the first of the pair of extension arms to a greater degree than the second to influence the child to turn in a direction toward the first of the pair of extension arms.

The extension arms may further comprise length adjustment mechanisms and the method may further comprise the step of adjusting the length of the extension arms by manipulating the length adjustment mechanisms.

The belt may further comprise a size adjustment mechanism to adjust the belt to fit children of varying sizes and the method may further comprise adjusting the size of the belt by manipulating the size adjustment mechanism.

BRIEF DESCRIPTION OF THE DRAWINGS

The subject matter regarded as the invention is particularly pointed out and distinctly claimed in the concluding portion of the specification. The invention, however, both as to organization and methods of operation, together with features, objects and advantages thereof may best be understood by reference to the following detailed description when read with the accompanying drawings in which:

DETAILED DESCRIPTION

Figure 1:
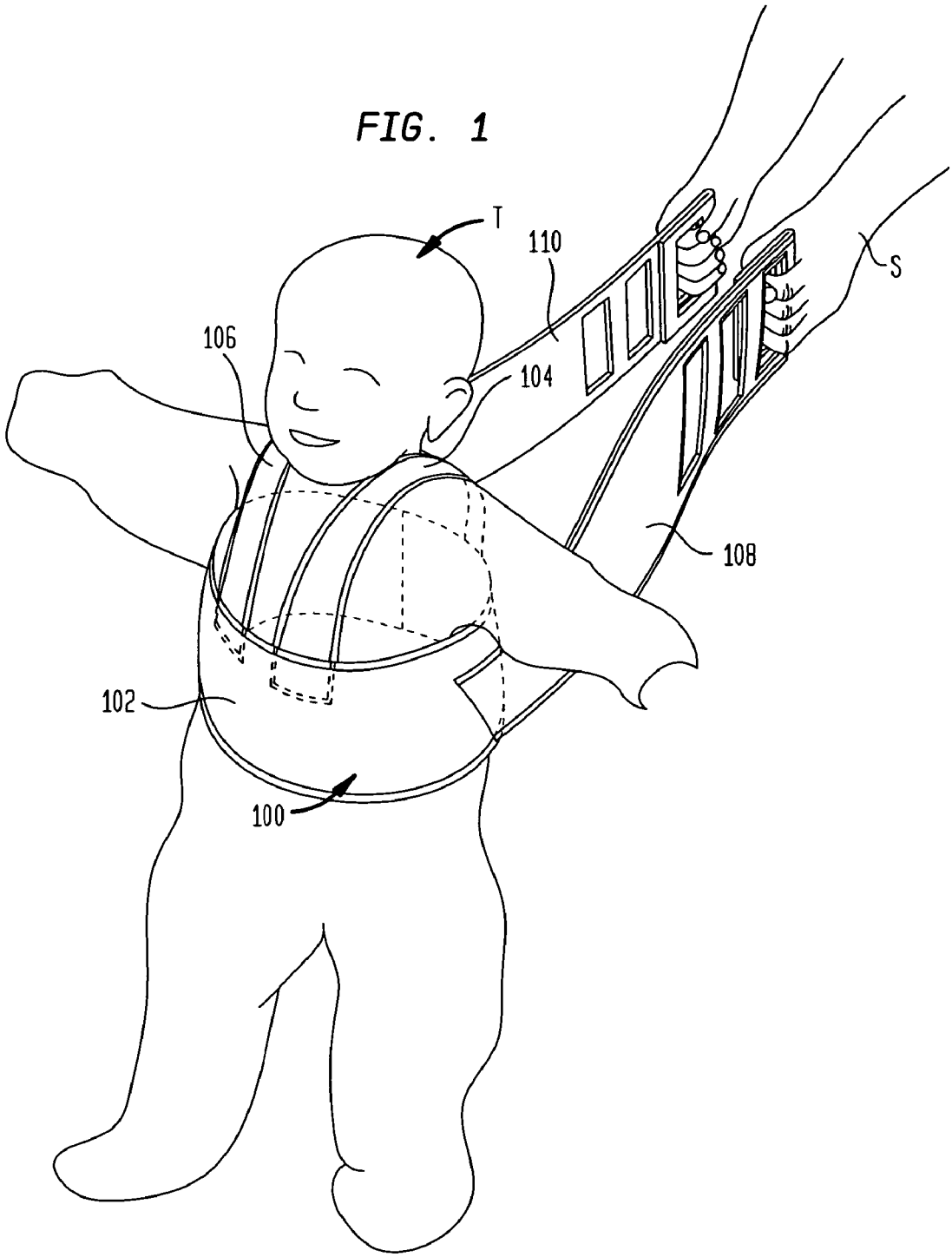
FIG. 1 is a perspective view of a toddler fitted with an embodiment of the child support harness in accordance with certain aspects of the present invention.

In the following are described the preferred embodiments of the child support harness in accordance with the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Where like elements have been depicted in multiple embodiments, identical reference numerals have been used in the multiple embodiments for ease of understanding.

Referring to the drawings, and initially to FIG. 1, there is shown a perspective view of a toddler T fitted with a child support harness 100 in accordance with a first embodiment of the present invention. As shown, the child support harness 100 comprises a belt 102 circumscribing the midsection of a toddler T. The child support harness 100 further comprises a first shoulder strap 104 and a second shoulder strap 106, the shoulder straps connected to the belt at each of their ends. The child support harness 100 also comprises a first support arm 108 and a second support arm 110 extending from the belt.

The structure and function of each of these elements will be discussed more fully below. However, it will be appreciated that the child support harness 100 may be fitted to a toddler T such that the belt 102 circumscribes the midsection of the toddler. As will be discussed, the size of this "working area," the area circumscribed by the belt, may be adjusted to accommodate toddlers T of ranging sizes. The belt 102 is preferably configured to be worn at positions between the toddler's waist and upper chest, referred to as the toddler's midsection. The shoulder straps 104, 106 may be fitted over the toddler's arms such that the shoulder straps support the belt 102 in the conventional manner. The overall length of the shoulder straps 104, 106 may be adjusted to accommodate toddlers T of varying sizes, as well as belt 102 positions relative to the waist and upper chest of the toddler.

As shown in FIG. 1, the first support arm 108 and second support arm 110 may be grasped by a supervisor S to at least partially support the toddler T as the toddler walks without the need for additional support. In addition, and as will be discussed further below, because of the structural features of the first support arm 108, second support arm 110, and their connection to the belt 103, the support arms may be utilized to steer the child in a supervisor S preferred direction.

Figure 2:
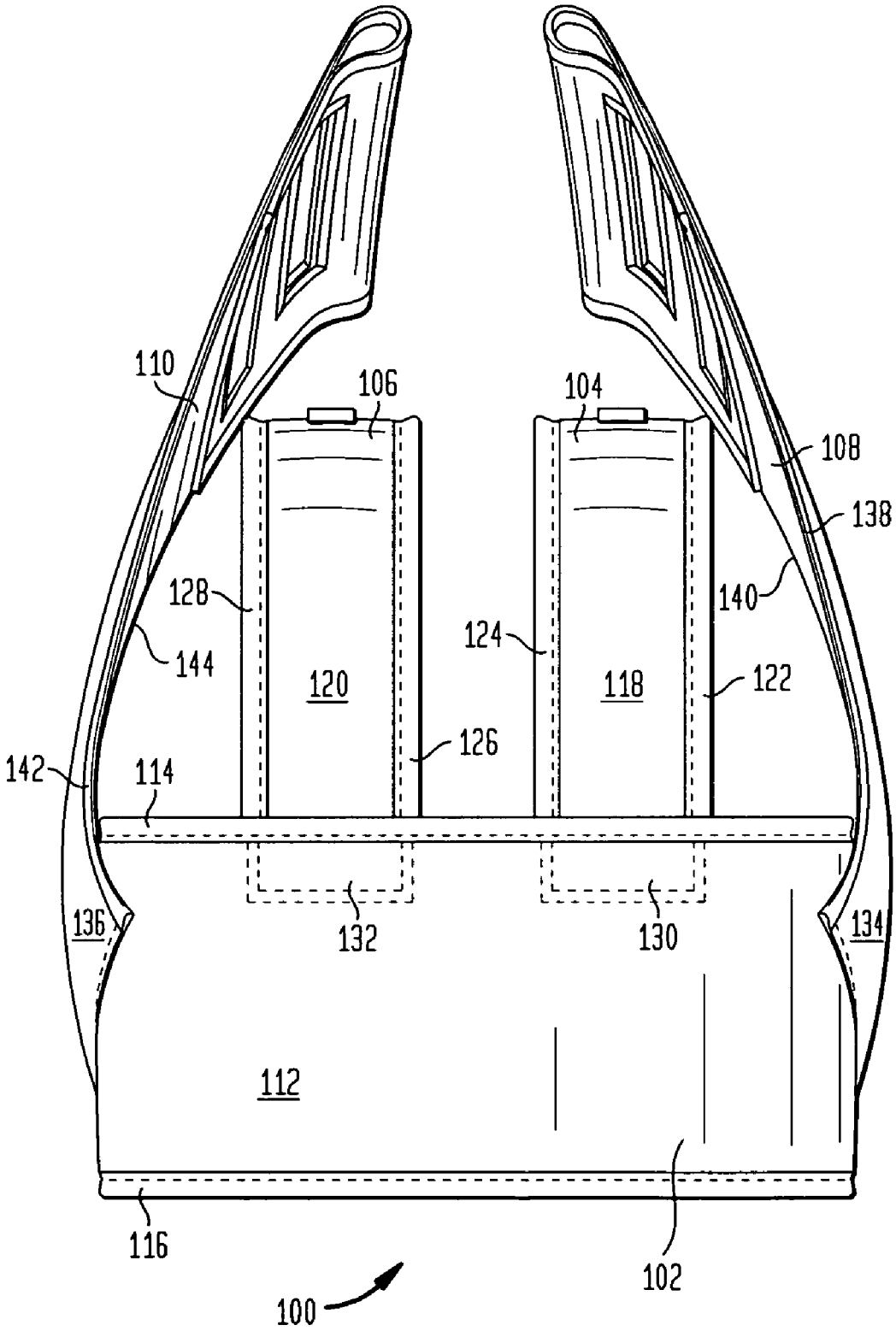
FIG. 2 is front view of the child support harness of FIG. 1.

FIG. 2 depicts a front view of the child support harness 100 shown in FIG. 1, without the toddler T. The components of the child support harness, including the belt 102, shoulder straps 104, 106, and support arms 108, 110, may be formed from a number of materials. In one embodiment, they may each be stitched from cloth with batting, or filler material, in between. Soft materials, such as cloth and batting, are preferred to ensure the comfort of the toddler. Still, other materials may be utilized such as flexible plastics or rubber materials.

As shown in FIG. 2, the cloth belt 102 may include a main portion 112 with stitched upper and lower edges 114, 116.

The shoulder straps 104, 106, may also include a main section 118, 120 bound by stitched edges 122, 124, 126, 128, stitched edges 122, 124 being associated with shoulder strap 118 and stitched edges 126, 128 being associated with the shoulder strap 120. The shoulder straps 104, 106 may be sewn to the belt 102 in the main portion 112 thereof at sewn sections 130, 132. In non-cloth embodiments, the shoulder straps 104, 106 may be secured to the belt 102 by other means, including chemical adhesion or heat fusion.

Figure 4:
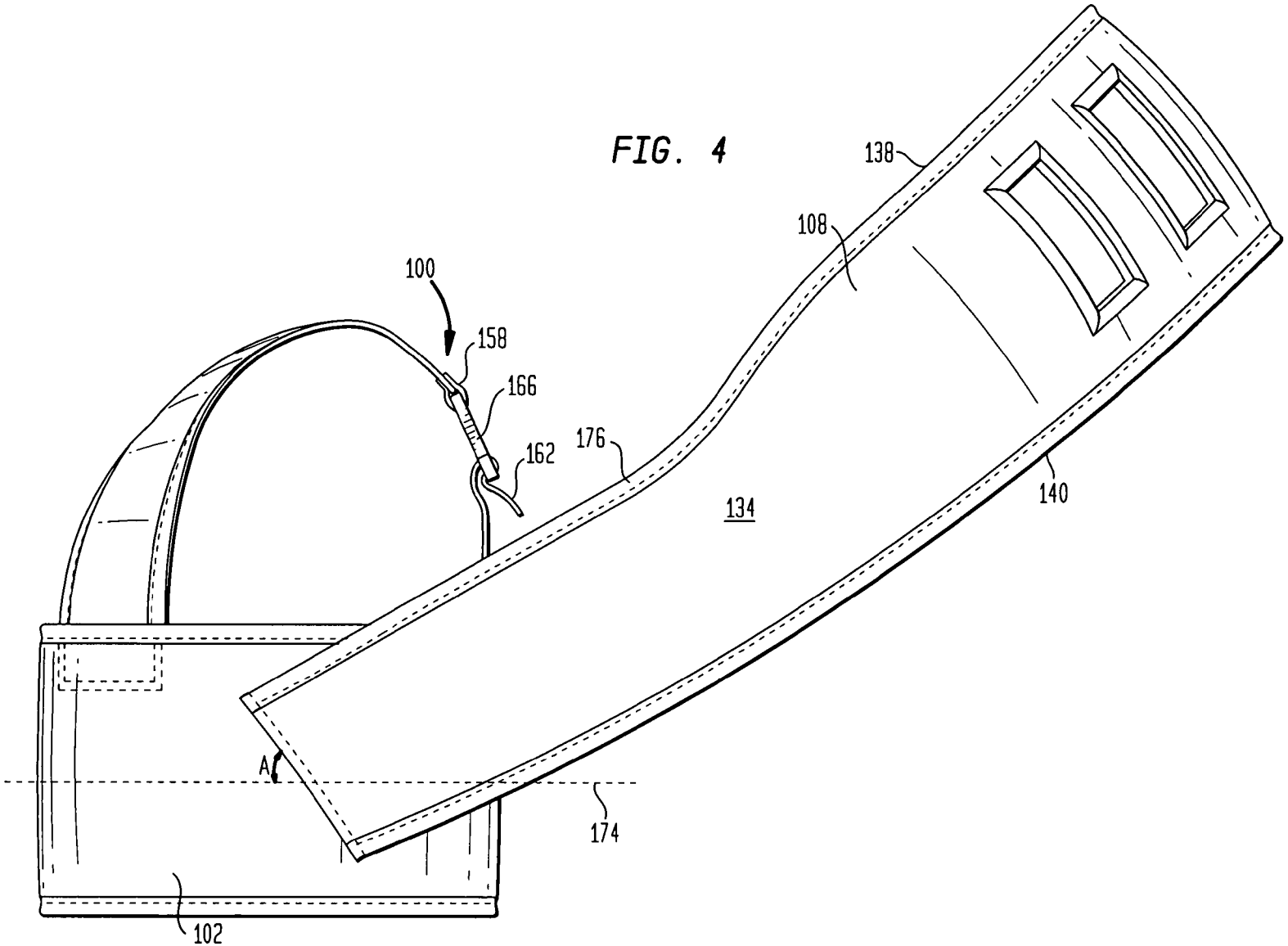
FIG. 4 is a side view of the child support harness of FIG. 1.

Referring briefly to FIG. 4 in conjunction with FIG. 2, it will be appreciated that the support arms 108, 110 may also include main portions 134, 136 bound by sewn edges 138, 140, 142, 144, sewn edges 138, 140 associated with support arm 108 and sewn edges 142, 144 associated with support arm 110. Although the support arms 108, 110 are not typically in continuous contact with a toddler T while in use, it is preferred that the support arms be relatively soft, even if not as soft as the belt 102 and shoulder straps 104, 106. Accordingly, even though the belt 102 and shoulder straps 104, 106 may be formed from cloth and batting, the support arms 108, 110 may be formed from materials more appropriate for repetitive tensile forces. In any event, it is preferred that the support arms 108, 110 remain flexible.

As shown in FIG. 2, the support arms 108, 110 comprise apertures (identified distinctly in FIG. 5) and may be folded to adjust the length of the support arms. It will be appreciated that this length adjustment allows the child support harness 100 to be more comfortably utilized for toddlers T and supervisor S of varying heights.

Figure 3:
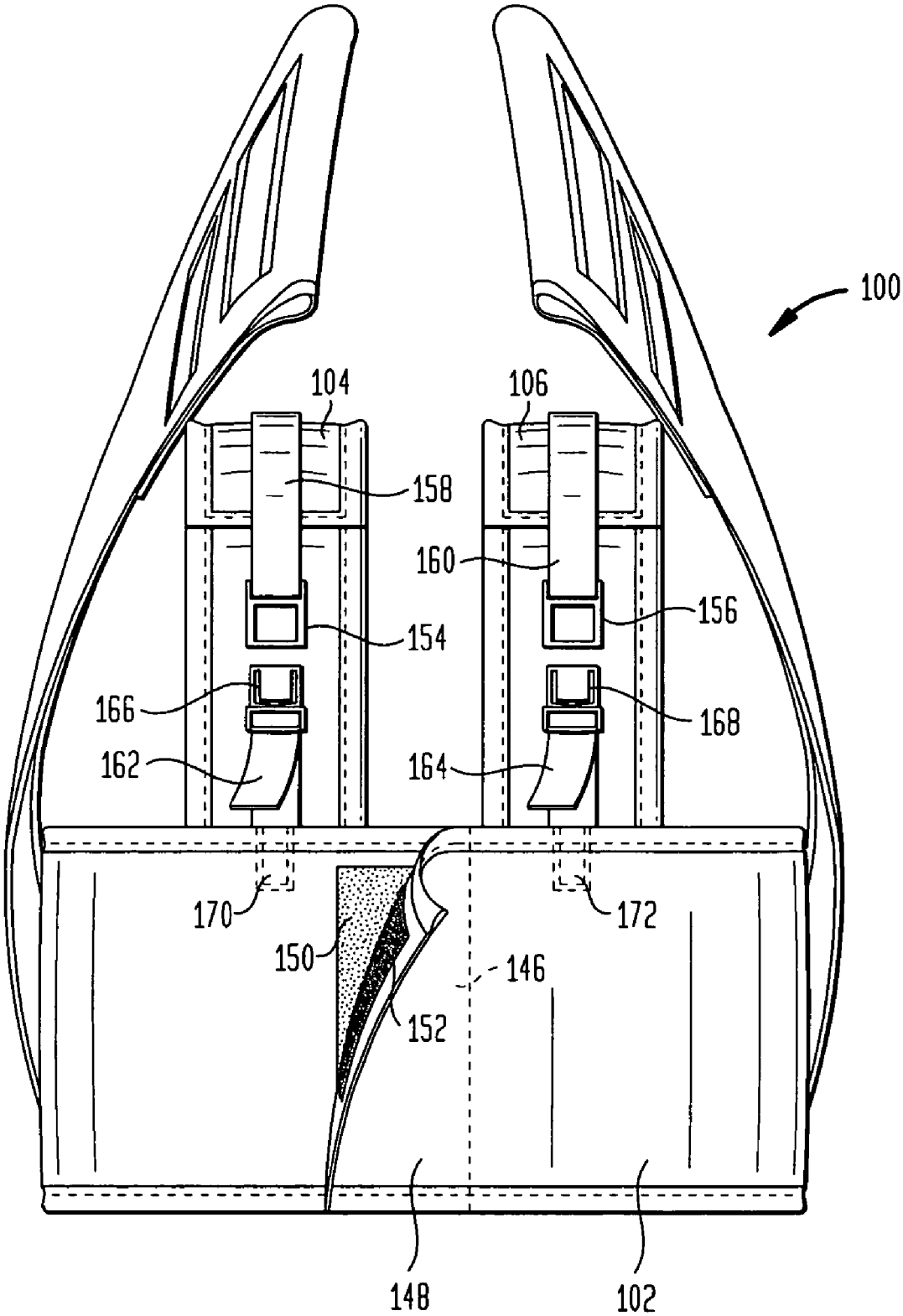
FIG. 3 is a rear view of the child support harness of FIG. 1.

FIG. 3 depicts a rear view of the child support harness 100 of FIG. 1. As shown in FIG. 3, the belt 102 may comprise a first end 146 and a second end 148, the second end being positioned underneath the first end in use. The first end may include female hook-and-loop type fasteners 150 with the second end including the male counterpart hook-and-loop type fastener 152. The two ends 146, 148 may overlap in an adjustment area roughly corresponding to the size of the hook-and-loop type fasteners 150, 152. This arrangement permits adjustment of the size of the belt 102 to fit various sized toddlers T by overlapping the hook-and-loop type fasteners 150, 152 to varying amounts. Other size adjustment mechanisms such as buttons or use of elastic may also be utilized.

The shoulder straps 104, 106 may also comprise adjustment mechanisms 154, 156. The adjustment mechanisms 154, 156 may comprise first straps 158, 160, and second straps 162, 164 connected by buckles 166, 168, respectively. In use, the second straps 162, 164 may be tightened or loosened depending on the size of the toddler T and the buckles 166, 168 buckled. Typically, the first straps 158, 160, will be of a fixed length and will be connected to the remaining portions of the corresponding shoulder straps 104, 106. The second straps 162, 164 may be sewn to the belt 102 at sewn sections 170, 172, which are opposite of sewn sections 130, 132 of the shoulder straps 104, 106 at the front of the belt. Other shoulder strap adjustment mechanisms may also be utilized, such as buttons.

Moving again to FIG. 4, there is shown a side view of the child support harness 100 of FIG. 1. In this view, it will be appreciated that the support arms 108, 110 (support arm 110 being hidden in this view behind support arm 108), may be sewn to the belt 102, or otherwise connected, at an angle A. Preferably, angle A is an angle other than 0° or 90° from a plane 174 formed by the belt 102. Typically, angle A is between 10° and 80°, but may be anywhere from 1° to 89°. In the most preferred embodiments, the angle is 45°.

Connecting the support arms 108, 110 to the belt 102 of the child support harness 100 at these angles, particularly those between approximately 30° and 60°, permits the support arms to extend back toward the supervisor S at a projection both rearward and upward. This relationship aids with the comfort level of the supervisor S in that it permits the supervisor to grasp the support arms 108, 100 without bending over. In addition, the angled connection permits a pulling force to be transferred from the support arms 108, 110 into the belt 102 to at least partially support the toddler T in a vertical direction. As the connection points between the support arms 108, 110 and the belt are at the toddler's T hips, pulling force on the support arms may be utilized to rotate the toddler's hips to steer the toddler in a supervisor's preferred direction. This is particularly useful in situations where a toddler T may be heading toward an undesirable location, such as stairs or unsuitable surfaces.

As shown with respect to support arm 108 in FIG. 4, each of the support arms 108, 110 may include a scalloped area 176 along the upper edge 138. This scalloped area 176 may vary in dimension based on the width of the support arm 108 and the angle and location of the connection point with the belt 102. However, it is preferred that the scalloped area 176 cuts away a sufficient portion of the support arm 108 such that a toddler's T arm will be free to operate without being interfered with by the support arm. Additionally, it will be appreciated that the support arm 108 may therefore be free to operate without interference with the toddler's T arm, so as not to injure the toddler or affect the toddler's comfort.

Figure 5:
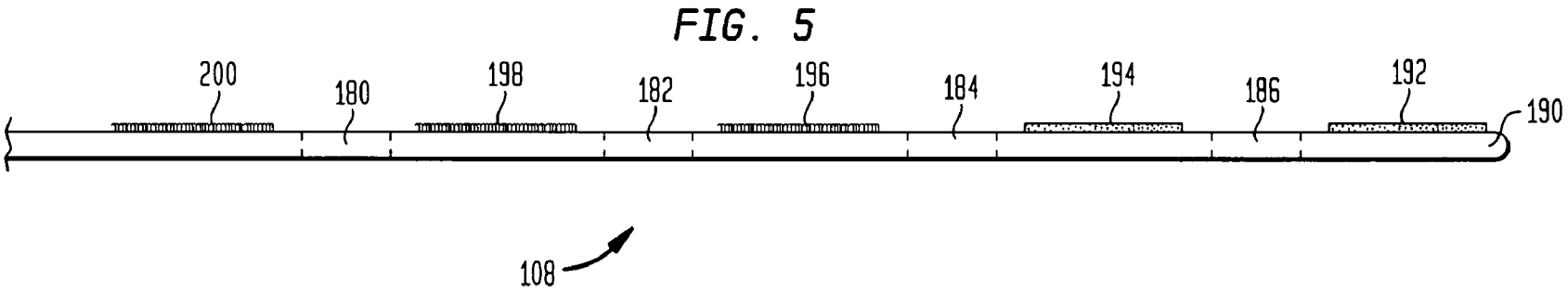
FIG. 5 is a cut-away top view of a support arm forming a portion of the child support harness of FIG. 1, the support arm in a first position.

As discussed previously, the support arms may be length adjustable. FIG. 5 depicts support arm 108 in the fully extended position, such that its length is maximized. The support arm 108 may include a series of apertures 180, 182, 184, 186 in spaced relation. At a distal end 190 of the support arm 108, a first patch of female hook-and-loop type fasteners 192 may be sewn or otherwise affixed to the support arm. Similarly, a second patch of female hook-and-loop type fasteners 194 may be sewn or otherwise attached to the support arm 108 between apertures 184 and 186. Three patches of male hook-and-loop type fasteners may also be sewn or otherwise attached to the support arm 108 with a first patch 196 between apertures 182 and 184, a second patch 198 between apertures 180 and 182, and a third patch 200 on the side of aperture 180 opposite patch 198.

In this extended position, a supervisor may grasp aperture 186 to manipulate the child support harness 100. This position is best suited for shorter children and/or taller supervisors, as it is the lengthiest support arm position.

Figure 6:
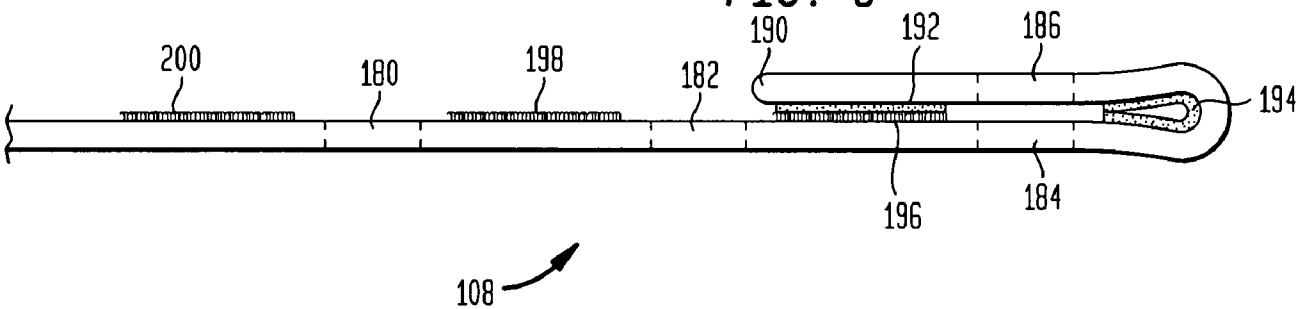
FIG. 6 is a cut-away top view of the support arm of FIG. 5 in a second position.

In a first level adjustment, shown in FIG. 6, the distal end 190 of the support arm 108 may be folded over such that apertures 186 and 184 align. Female hook-and-loop type fasteners 194 may similarly be folded over. Female hook-and-loop type fasteners 192 may be mated with male hook-and-loop type fasteners 196 to secure the support arm 108 in the position shown in FIG. 6. Once in this position, a user may grasp the support arm 108 through apertures 184 and 186, now aligned, to utilize the child support harness 100. This position represents a position for use by individuals of average size and is anticipated to be the most common position for the support arm 108. This position is also shown in use in FIG. 1.

Figure 7:
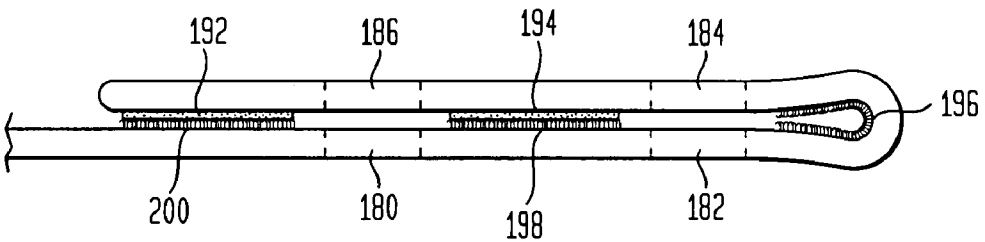
FIG. 7 is a cut-away top view of the support arm of FIG. 5 in a third position.

In the shortest position, the support arm 108 may be folded as shown in FIG. 7. As shown, the support arm 108 may be folded such that two sets of apertures, apertures 186 and 180 and then apertures 182 and 184, align. In so doing, female hook-and-loop type fasteners 192, 194 will mate with male hook-and-loop type fasteners 200, 198, respectively. Male hook-and-loop type fastener 196 may be folded over at what is now the extreme distal end of support arm 108. This position represents the shortest position of the support arm, and may be utilized by shorter supervisors S or taller toddlers T, or combinations thereof. This position is also shown in FIGS. 2-4.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A child support harness comprising:

a belt adapted to circumscribe a child's midsection, when circumscribing the child's midsection said belt having a front portion generally at the child's chest, a back portion generally at the child's back, a left side portion generally adjacent to the child's left hip, and a right side portion generally adjacent to the child's right hip;

a left support arm extending from said left side portion of said belt;

a right support arm extending from said right side portion of said belt;

wherein said left and right support arms may be held by a supervisor to support the child while walking and wherein said belt further comprises a first end and a second end, said first end having female hook-and-loop type fastening on one side of said belt and said second end having corresponding male hook-and-loop type fastening on a second side of said belt, such that said female and said male hook-and-loop type fastening may be connected when said belt is circumscribed about the child, said hook-and-loop type fastening adapted to provide an adjustment mechanism for adjusting the length of said belt to fit children of varying sizes.

2. The child support harness of claim 1, wherein said fist support arm and said second support arm are adapted for use in steering the child in a supervisor dictated direction.

3. The child support harness of claim 1, wherein said left support arm and said right support arm extend toward the supervisor when situated behind the child.

4. The child support harness of claim 1, wherein said support arms extend at an angle of between 30 and 60 degrees with respect to a plane formed by said belt.

5. The child support harness of claim 1, further comprising a left shoulder strap and a right shoulder strap, each of said shoulder straps having a front portion associated with said front portion of said belt and a back portion associated with said back portion of said belt.

6. The child support harness of claim 5, wherein said shoulder straps are adjustable to fit children of varying sizes.

7. The child support harness of claim 6, wherein said shoulder straps comprise buckles to facilitate adjustment.

8. The child support harness of claim 1, wherein said belt is adjustable to fit children of varying sizes.

9. The child support harness of claim 1, wherein said left support arm comprises a first end at said belt and a distal second end, said distal second end comprising a length adjustment feature adapted to adjust the length of said left support arm.

10. A child support harness comprising:

a belt adapted to circumscribe a child's midsection, when circumscribing the child's midsection said belt having a front portion generally at the child's chest, a back portion generally at the child's back, a left side portion generally adjacent to the child's left hip, and a right side portion generally adjacent to the child's right hip;

a left support arm extending from said left side portion of said belt;

a right support arm extending from said right side portion of said belt;

wherein said left and right support arms may be held by a supervisor to support the child while walking;

wherein said left support arm comprises a first end at said belt and a distal second end, said distal second end comprising a length adjustment feature adapted to adjust the length of said left support arm;

wherein said length adjustment feature comprises a series of apertures wherein an extreme portion of said distal second end may be folded back upon remaining portions of said left support arm such that at least two apertures overlap to shorten the length of said left support arm.

11. The child support harness of claim 10, further comprising hook-and-loop type fasteners between at least some of said apertures of said length adjustment feature, said hook-and-loop type fasteners adapted to facilitate connection of the folded portion of said distal second end with said remaining portions of said left support arm.

12. A device for assisting toddlers with walking, said device comprising:

a belt having a first end and a second end, said belt having an open condition in which said first end is spaced from said second end to form a working area and a closed condition in which said first end is in communication with said second end to enclose said working area;

a first extension arm attached to said belt at a first side of said working area;

a second extension arm attached to said belt at a second side of said working area, said second side of said working area opposite said first side of said working area;

wherein a toddler may be placed in said working area of said belt in said closed position such that the toddler's hips may be adjacent the first and second sides of said working area so a supervisor may grasp and pull said first and second extension arms to at least partially support the toddler and assist the toddler with walking and wherein said extension arms comprise length adjustment mechanisms, said length adjustment mechanisms including apertures formed in said extension arms such that said extension arms may be folded to overlap at least two apertures, the apertures adapted to be grasped by the supervisor.

13. The device of claim 12, wherein said first and second extension arms extend from said belt at an angle other than zero degrees with respect to a plane formed through said belt in said closed condition.

14. The device of claim 12, wherein one support arm may be pulled to a greater extent than the other, the pulled support arm influencing a directional change in the walking toddler toward the direction of the pulled support arm.

15. The device of claim 14, wherein said device further comprises shoulder straps extending from a front portion of said belt to a rear portion, said should straps adapted to be placed over the toddler's shoulders.

* * * * *